US009289058B2

(12) United States Patent
Flaherty

(10) Patent No.: US 9,289,058 B2
(45) Date of Patent: Mar. 22, 2016

(54) ADJUSTABLE HEIGHT DESK PLATFORM

(71) Applicant: Gemmy Industries Corp., Coppell, TX (US)

(72) Inventor: Daniel G. Flaherty, Coppell, TX (US)

(73) Assignee: Varidesk, LLC, Coppell, TX (US)

( * ) Notice: Subject to any disclaimer, the term of this patent is extended or adjusted under 35 U.S.C. 154(b) by 0 days.

(21) Appl. No.: 14/230,499

(22) Filed: Mar. 31, 2014

(65) Prior Publication Data

US 2015/0272316 A1 Oct. 1, 2015

(51) Int. Cl.

| | |
|---|---|
| ***A47B 9/00*** | (2006.01) |
| ***A47B 9/16*** | (2006.01) |
| ***A47B 3/08*** | (2006.01) |
| *A47B 3/02* | (2006.01) |

(52) U.S. Cl.

CPC ..... *A47B 9/16* (2013.01); *A47B 3/0818* (2013.01); *A47B 2003/025* (2013.01)

(58) Field of Classification Search

CPC ..... A47B 2009/065; A47B 9/18; A47B 9/00; A47B 9/02; A47B 3/0916; A47B 3/0915; A47B 3/0912

USPC ..... 108/131, 133, 132, 147, 145, 129, 116, 108/115; 248/188.6, 188.2

See application file for complete search history.

(56) References Cited

U.S. PATENT DOCUMENTS

| | | | | | |
|---|---|---|---|---|---|
| 145,858 | A | * | 12/1873 | Fling et al. | 108/133 |
| 150,220 | A | * | 4/1874 | Babcock | 108/133 |
| 165,885 | A | | 7/1875 | Sloan | |
| 294,954 | A | * | 3/1884 | Bags | 108/147 |
| 831,994 | A | * | 9/1906 | Rudman | 108/147 |
| 2,664,329 | A | * | 12/1953 | Kraska | 108/133 |
| 2,761,743 | A | * | 9/1956 | Cottar | 108/116 |
| 2,799,546 | A | * | 7/1957 | Lowry | 108/116 |
| 2,814,541 | A | * | 11/1957 | Derman | 108/145 |
| 2,818,256 | A | * | 12/1957 | Hopper | 108/116 |
| 2,846,282 | A | * | 8/1958 | Barker, Jr. | 108/116 |
| 4,662,286 | A | | 5/1987 | Barabas et al. | |
| 4,747,353 | A | * | 5/1988 | Watt | 108/147 |
| 2002/0092445 | A1 | * | 7/2002 | Glover et al. | 108/129 |
| 2011/0023758 | A1 | * | 2/2011 | Overgaard et al. | 108/147 |
| 2014/0041554 | A1 | * | 2/2014 | Huang | 108/147 |

FOREIGN PATENT DOCUMENTS

CN 101 849 736 B 4/2012

OTHER PUBLICATIONS

International Search Report issued Jun. 10, 2015 in International Patent Application No. PCT/US2015/020392.

Written Opinion issued Jun. 10, 2015 in International Patent Application No. PCT/US2015/020392.

Extended European Search Report issued Jun. 10, 2015 in European Patent Application No. 15 161 122.5.

* cited by examiner

*Primary Examiner* — Jose V Chen

(74) *Attorney, Agent, or Firm* — Venable LLP; Steven J. Schwarz

(57) ABSTRACT

An adjustable height desk platform includes: a platform including a substantially flat work surface and a lower surface opposite to the work surface; a first leg member and a second leg member coupled to the lower surface, the first leg member and the second leg member each movable between a fully raised position and a fully lowered position; a rack and pinion gear system associated with the first leg member and the second leg member; and a latch mechanism associated with the rack and gear system, the latch mechanism adapted to selectively immobilize the rack and pinion gear system to retain the first leg member and the second leg member in the fully raised position or the fully lowered position.

26 Claims, 10 Drawing Sheets

ADJUSTABLE HEIGHT DESK PLATFORM

TECHNICAL FIELD

This application relates generally to work surfaces, and more particularly, to an adjustable height desk platform.

BACKGROUND

Desk platforms are known in the art. Desk platforms can be used on top of an existing surface (e.g., a conventional desk or table) to raise the height of the work surface. Alternatively, desk platforms can be used over a person's lap when working from a chair, sofa, or other surface that lacks a useable work surface. In order to vary the height of the desk platform, the platform may include adjustable legs movable between raised and lowered positions.

SUMMARY

According to an embodiment, an adjustable height desk platform includes: a platform including a substantially flat work surface and a lower surface opposite to the work surface; a first leg member and a second leg member coupled to the lower surface, the first leg member and the second leg member each movable between a fully raised position and a fully lowered position; a rack and pinion gear system associated with the first leg member and the second leg member; and a latch mechanism associated with the rack and gear system, the latch mechanism adapted to selectively immobilize the rack and pinion gear system to retain the first leg member and the second leg member in the fully raised position or the fully lowered position.

According to another embodiment, a method of using the desk platform comprises: disengaging the latch mechanism; lifting the platform, thereby raising the first leg member and the second leg member from the fully lowered position to the fully raised position; and re-engaging the latch mechanism.

Other features and advantages will become apparent from the following description, taken in connection with the accompanying drawings, wherein, by way of illustration and example, embodiments of the invention are disclosed.

BRIEF DESCRIPTION OF THE DRAWINGS

The features and advantages of the invention will be apparent from the following description, as illustrated in the accompanying drawings wherein like reference numbers generally indicate identical, functionally similar, and/or structurally similar elements.

FIG. 1 depicts the adjustable height desk platform in a fully raised position.

DETAILED DESCRIPTION

Embodiments of the invention are discussed in detail below. In describing embodiments, specific terminology is employed for the sake of clarity. However, the invention is not intended to be limited to the specific terminology so selected. While specific embodiments are discussed, it should be understood that this is done for illustration purposes only. A person skilled in the relevant art will recognize that other components and configurations can be used without departing from the spirit and scope of the invention.

The present invention relates to an adjustable height desk platform that can be used, for example, to support reading materials, writing materials, computers, and other electronics, etc. To facilitate working at a variety of different heights, the desk platform can be adjustable in height, as will be described in more detail, below.

Figure 5:
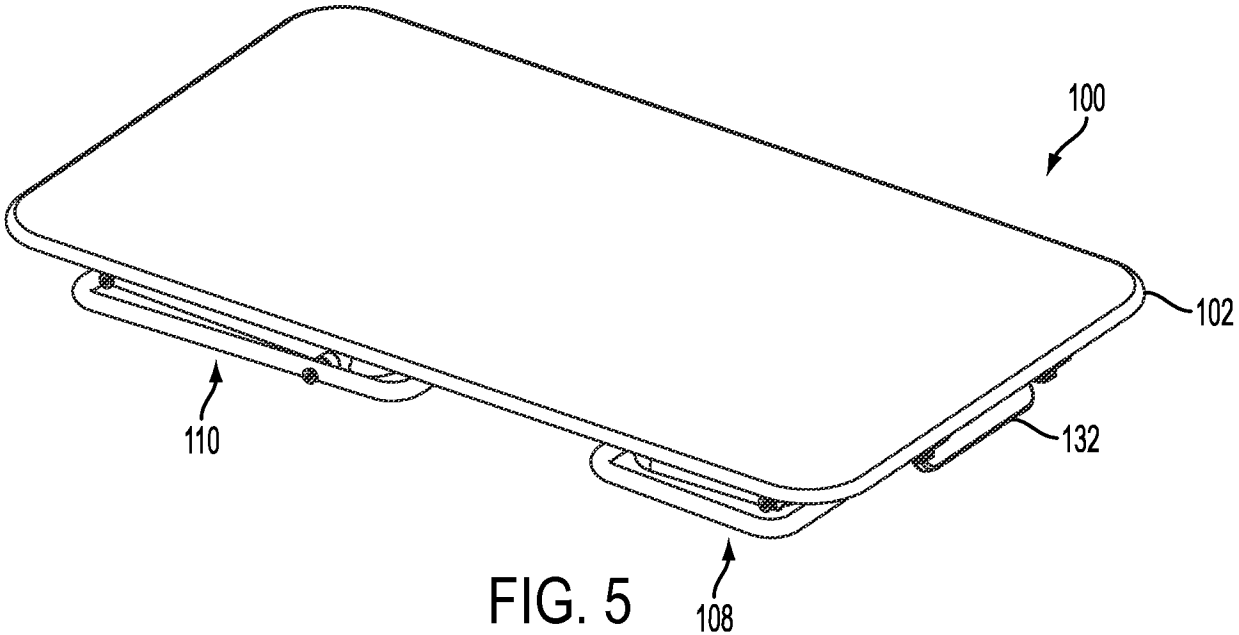
FIG. 5 is a front, perspective view of the adjustable height desk platform of FIG. 1, shown in a fully lowered position.
Figure 6:
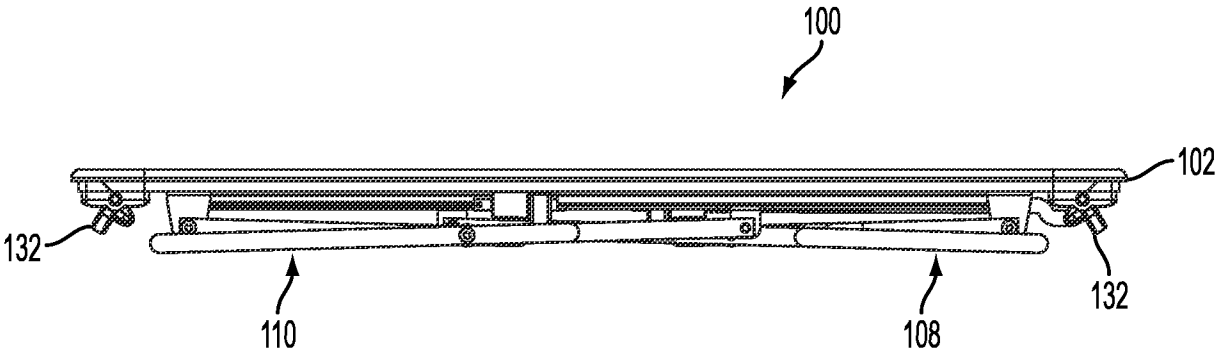
FIG. 6 is a front view of the adjustable height desk platform of FIG. 1, shown in the fully lowered position.

FIGS. 1-4 depict an embodiment of the adjustable height desk platform 100 in a fully raised position, and FIGS. 5-6 depict the desk platform 100 in a fully lowered position. Although not shown, the desk platform 100 can also be located in one or more intermediate positions between the fully raised and fully lowered positions.

Figure 1:
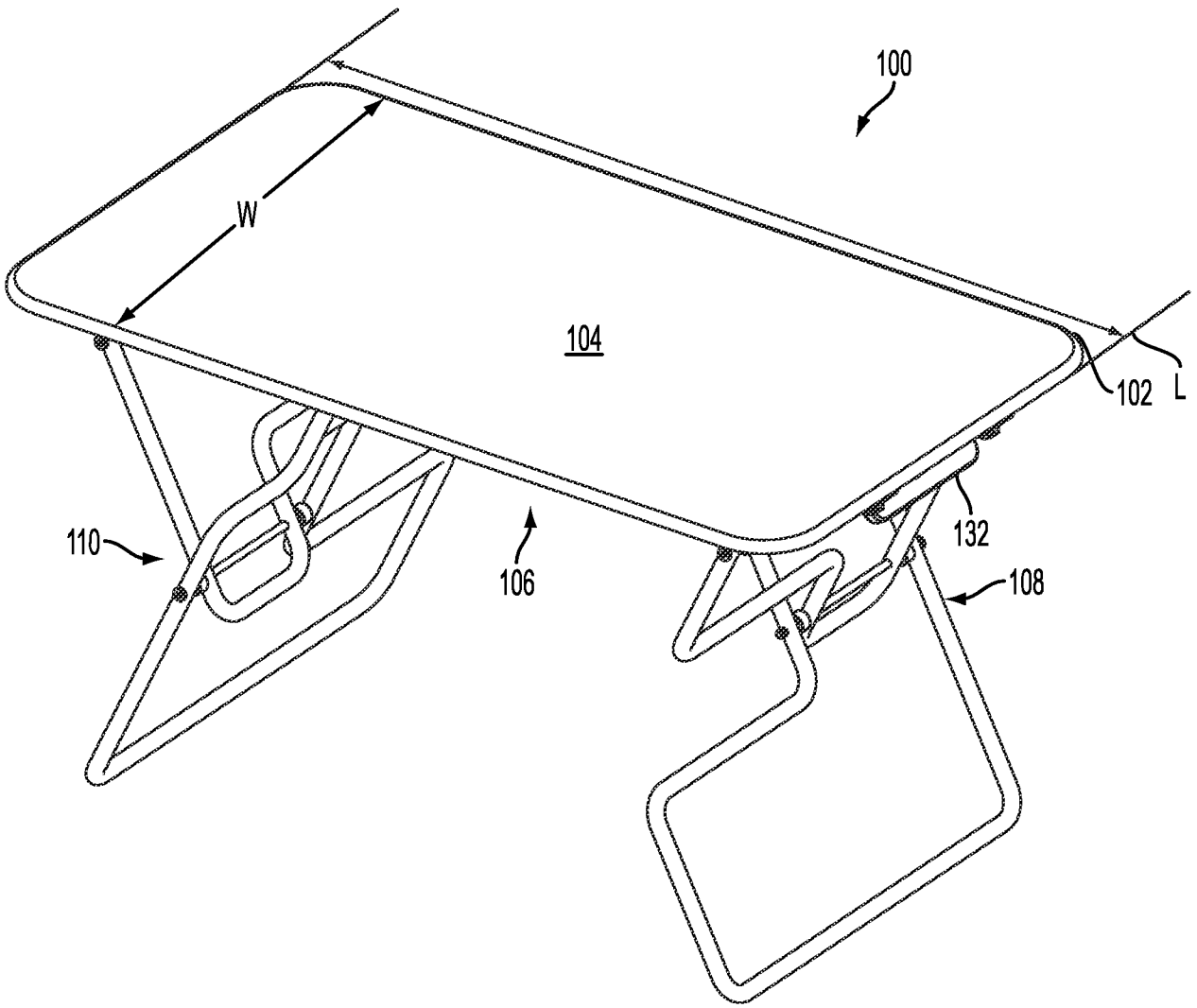
FIG. 1 is a front, perspective view of an embodiment of an adjustable height desk platform.

Referring to FIG. 1, the desk platform 100 can include a platform 102 having an upper surface that defines a substantially flat work surface 104, and a lower surface 106 opposite to the work surface 104. As shown in FIG. 1, the work surface 104 can occupy the entire upper surface of the platform 102. As also shown, the work surface 104 can be substantially flat and devoid of any obstructions that would disrupt placing items on the work surface 104. However, other embodiments may include features (not shown) in the work surface 104, such as depressions or pockets to hold writing utensils or other items, or a raised edge to prevent items from rolling off the work surface 104. The platform 102 can be constructed from a variety of materials, including plastic, composites, wood, particle board, cardboard, or other materials known in the art, or combinations thereof.

Still referring to FIG. 1, the work surface 104 can define length L of between about 15 inches and about 36 inches, for example between about 20 inches and about 30 inches. The work surface 104 can also define a width W of between about 10 inches and about 20 inches, for example between about 12 inches and about 16 inches. One of ordinary skill in the art will appreciate from this disclosure, however, that other sizes and shapes of the work surface 104 are possible.

Figure 2:
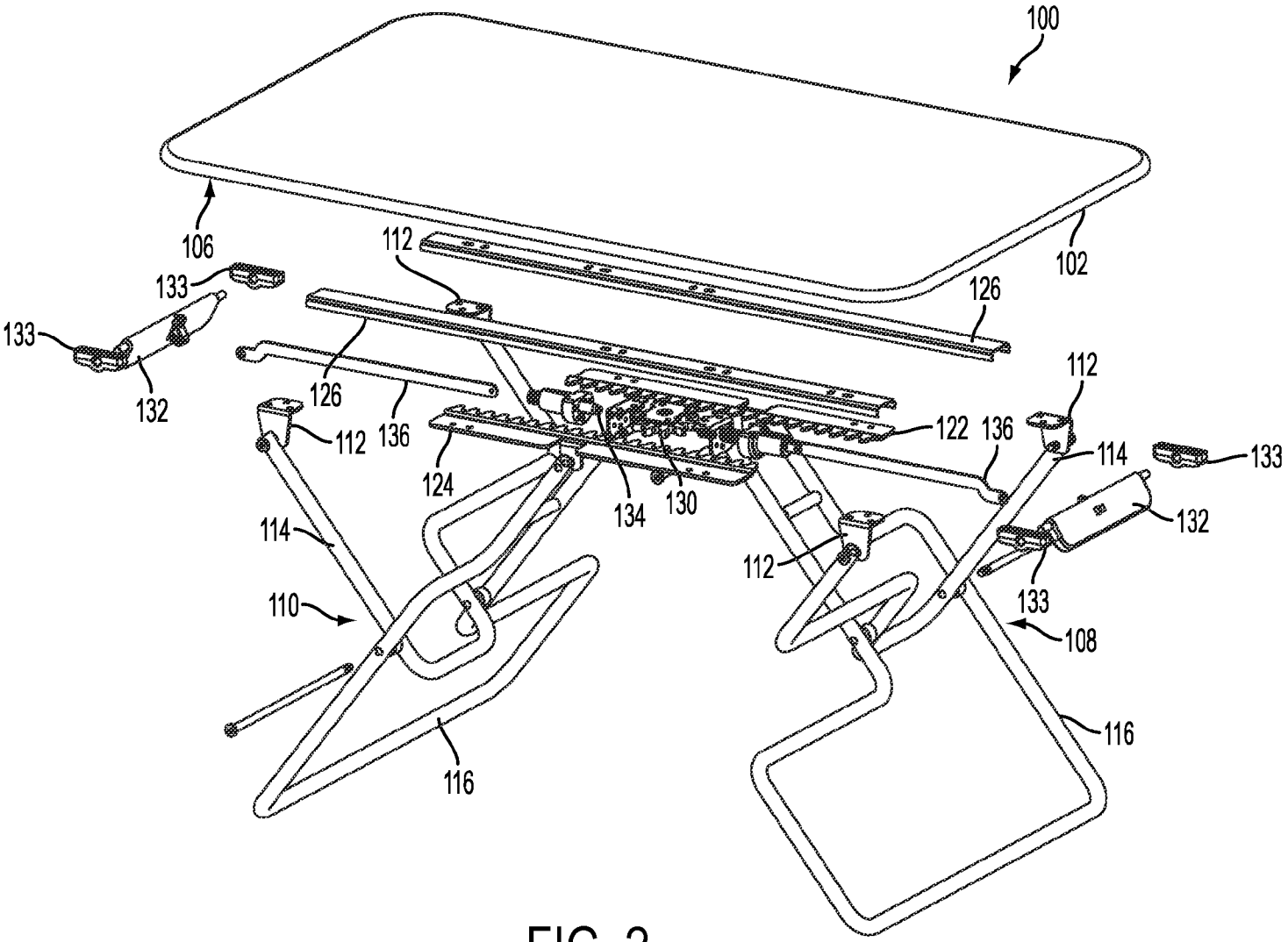
FIG. 2 is a front, perspective, exploded view of the adjustable height desk platform of FIG. 1.

Still referring to FIGS. 1-4, the desk platform 100 can include a first leg member 108 and a second leg member 110 coupled to the lower surface 106 of the platform 102. When in the fully raised position, or any of the intermediate positions, the first leg member 108 and second leg member 110 together support the desk platform 100 above an existing surface, such as an office desk, sofa, or other surface. As best shown in FIG. 2, the first and second leg members 108, 110 can each be pivotably coupled to the platform 102 using brackets 112, or other structures known in the art.

Still referring to FIG. 2, each of the first leg member 108 and the second leg member 110 can comprise two parts joined together. For example, each of the first leg member 108 and the second leg member 110 can include a first leg component 114 coupled to the lower surface 106 of the platform 102, for example, using the brackets 112. Each leg member 108, 110 can also include a second leg component 116 pivotably coupled to the first leg component 114, for example, using screws, bolts, rivets, hinges, or other structures. By incorporating first and second leg components 114, 116, each leg member 108, 110 can fold in an ergonomic and compact manner when moving between fully raised and fully lowered positions. One of ordinary skill in the art will appreciate from this disclosure, however, that alternate embodiments can include leg members 108, 110 that are a single rigid component, or that comprise multiple components rigidly connected to one another. According to embodiments, a portion of each second leg component 116 can be coupled to a rack and pinion gear system, to be described in more detail below.

Figure 7:
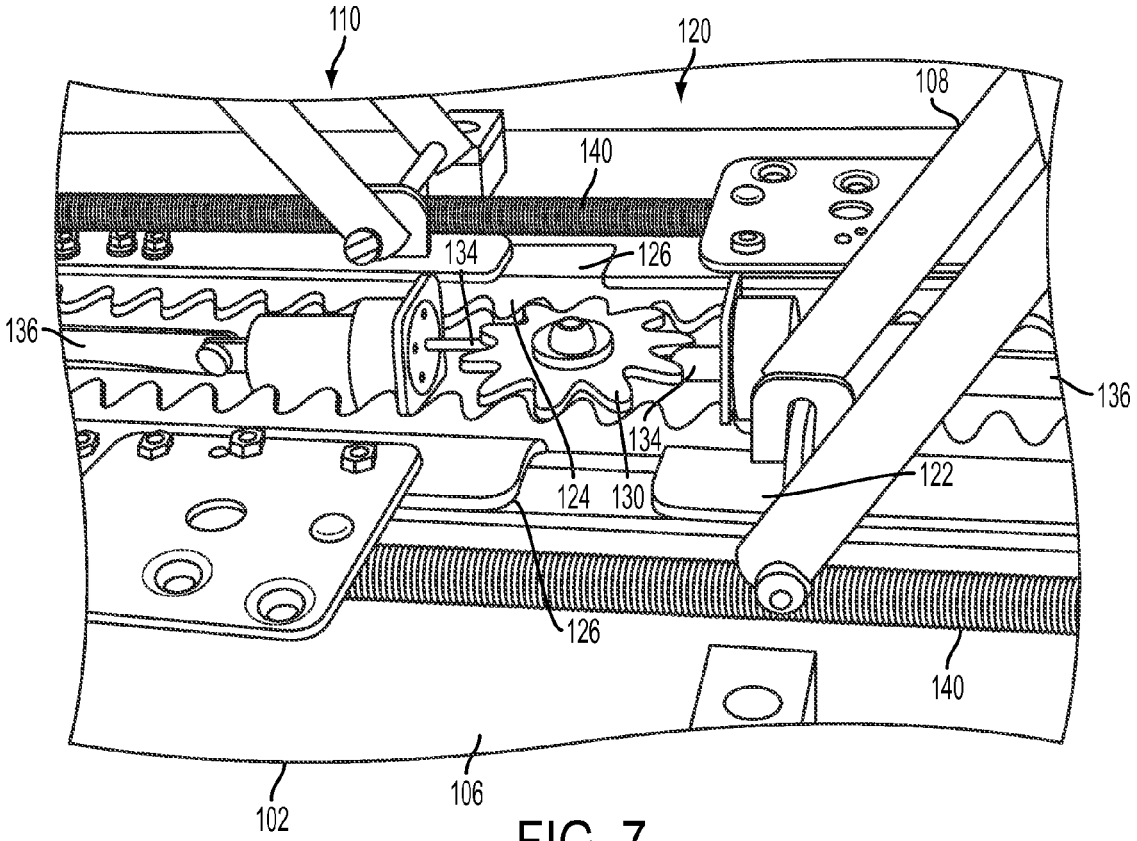
FIG. 7 is a bottom, perspective view of a portion of the adjustable height desk platform of FIG. 1.
Figure 8:
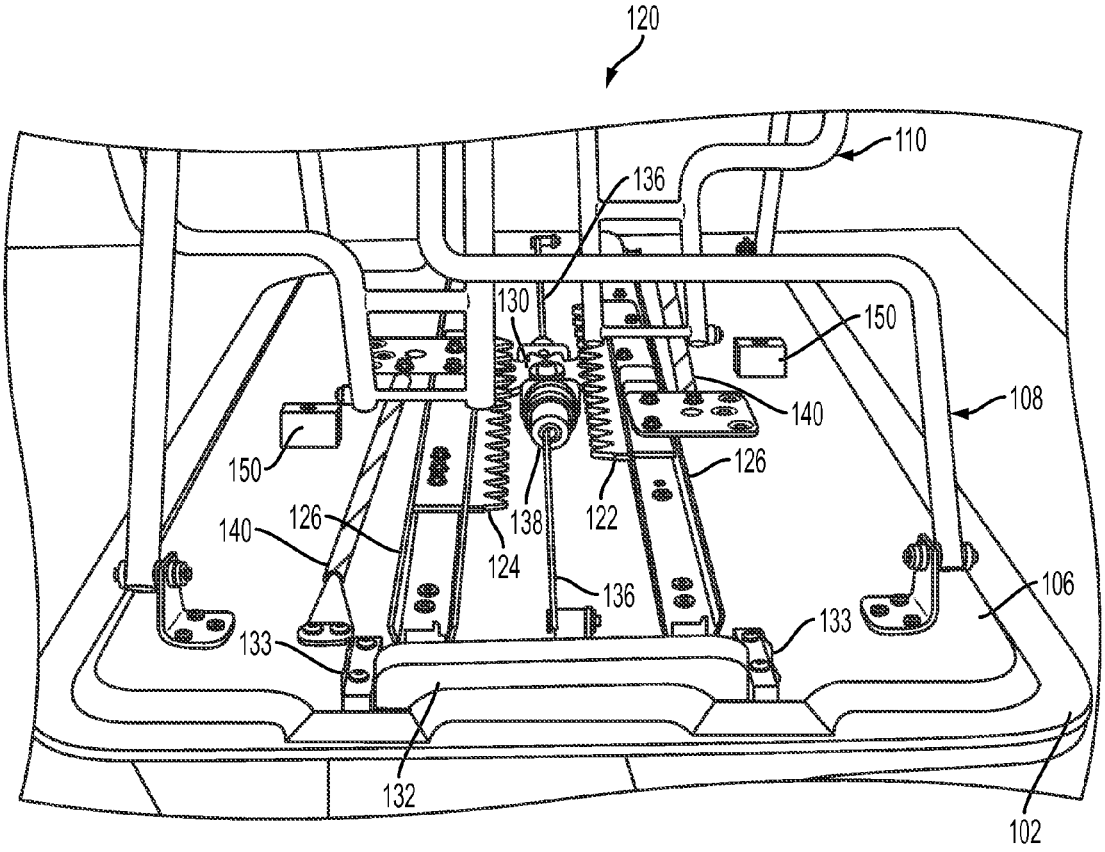
FIG. 8 is another bottom, perspective view of a portion of the adjustable height desk platform of FIG. 1.

Referring to FIGS. 7 and 8, an embodiment of a rack and pinion gear system 120 according to the present invention is shown. The rack and pinion gear system 120 can be used in conjunction with one or more latch mechanisms, described later, to releasably hold the leg members 108, 110 (only partially shown in FIGS. 7 and 8) in the fully raised position, fully lowered position, or in one or more intermediate positions therebetween.

The rack and pinion gear system 120 can include a first rack gear 122 associated with the first leg member 108, and a second rack gear 124 associated with the second leg member 110. As shown, the first and second rack gears 122, 124 can be slidably mounted to the lower surface 106 of the platform 102, for example, using linear bearings 126 or other structures known in the art. Accordingly, the first rack gear 122 and second rack gear 124 can slide along the lower surface 106 substantially in parallel to one another, e.g., in and out of the paper as seen in FIG. 8.

The first leg member 108 can be coupled to the first rack gear 122, for example, through its second leg component 116, such that moving the first leg member 108 between the fully raised and fully lowered positions causes the first rack gear 122 to slide along the lower surface 106 of the platform, e.g., within linear bearing 126. Likewise, second leg member 110 can be coupled to the second rack gear 124, for example, through its second leg component 116, such that moving the first leg member 110 between the fully raised and fully lowered positions causes the second rack gear 124 to slide along the lower surface 106. According to embodiments, simultaneously raising and lowering the first and second leg members 108, 110 can cause the first rack gear 122 and second rack gear 124 to move in substantially parallel, but opposite, directions.

Still referring to FIGS. 7 and 8, the rack and pinion gear system 120 can also include a pinion gear 130 located in contact with the first and second rack gears 122, 124. For example, the pinion gear 130 can be rotatably mounted to the lower surface 106 of the platform 102 in between the movement paths of the first and second rack gears 122, 124. Due to their mutual engagement with the pinion gear 130, the first and second rack gears 122, 124 can be constrained to substantially proportional movement in substantially parallel, but opposite, directions. As a result, movement of the first leg member 108 and second leg member 110 can be synchronized. Additionally, preventing rotation of the pinion gear 130 can immobilize the first and second rack gears 122, 124, and in turn, can substantially lock the position of the corresponding first and second leg members 108, 110 (e.g., in the fully raised position, fully lowered position, or an intermediate position there between).

Still referring to FIGS. 7 and 8, the desk platform 100 can also include a latch mechanism operable to engage and immobilize the pinion gear 130, or alternatively, to disengage the pinion gear 130. As a result, the latch mechanism can control whether the first and second members 108, 110 are locked in position, or are free to move with respect to the platform 102. Alternate embodiments can include a latch mechanism that engages some other part of the rack and pinion gear system 120, such as one or more of the rack gears 122, 124, or some other part associated therewith.

The latch mechanism can include a handle 132 that is movable by a user, for example, pivotable with respect to the platform 102. The handle 132 can be connected to a latch member 134 (see FIGS. 2 and 7) adapted to engage the pinion gear 130. For example, the handle 132 can be connected to the latch member 134 by a linkage member 136. According to embodiments, the handle 132 can be pivotably mounted to the lower surface 106 of platform 102 by opposite pairs of pivot blocks 133, however, other configurations are possible.

Figure 3:
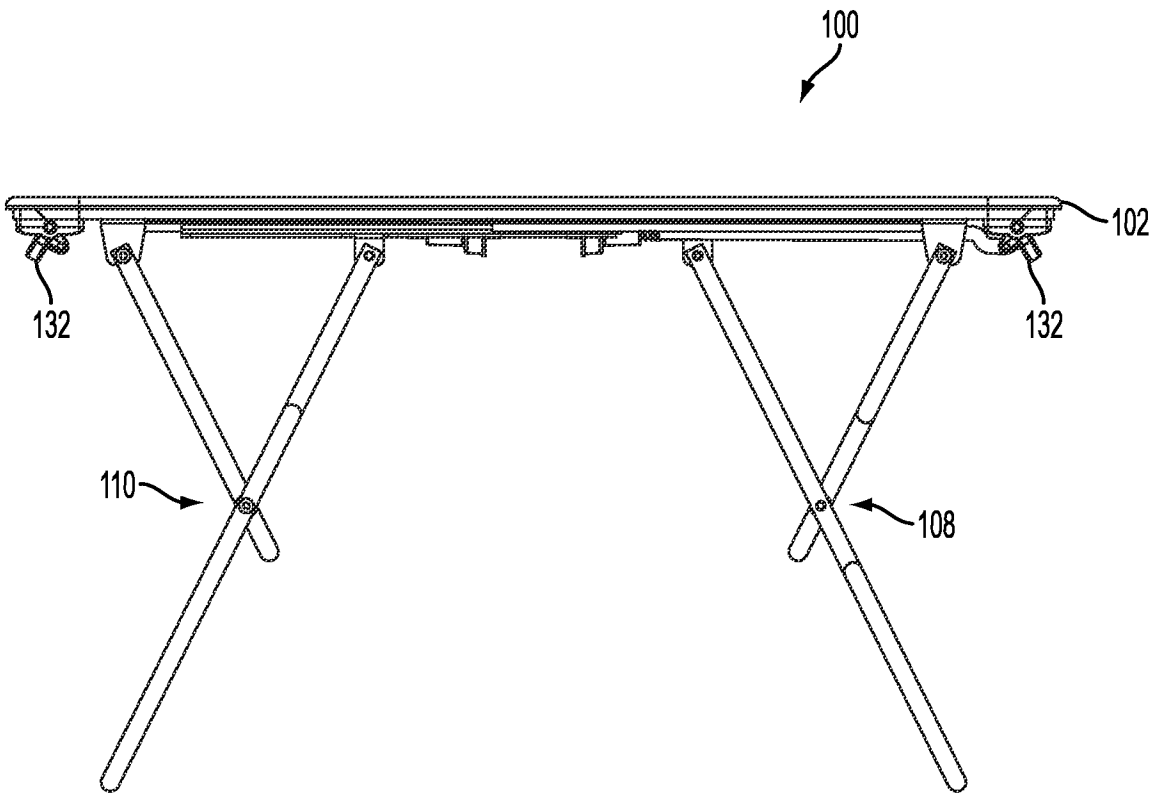
FIG. 3 is a front view of the adjustable height desk platform of FIG. 1.
Figure 4:
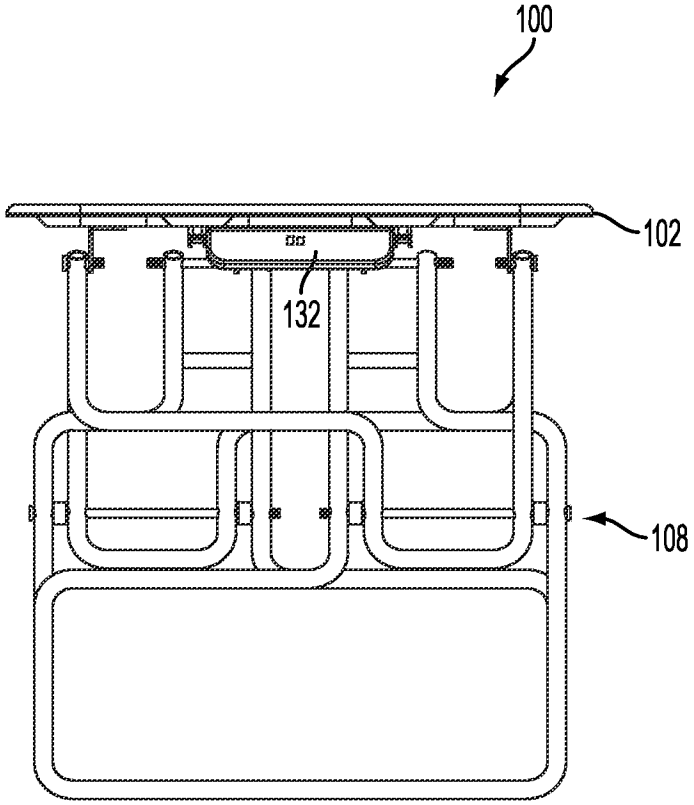
FIG. 4 is a side view of the adjustable height desk platform of FIG. 1.

According to embodiments, the latch member 134 can be biased into engagement with the pinion gear 130, such that the latch member 134 normally immobilizes the pinion gear 130. As a result, absent disengagement of the latch mechanism by the user, the latch mechanism will lock the rack and pinion gear system, 120, and substantially immobilize the first and second leg members 108, 110. According to embodiments, springs or other elastic members associated with latch housing 138 can bias the latch member 134 into engagement with the pinion gear 130, however, other configurations are possible. For example, additionally or alternatively, springs or other elastic members associated with the handle 132 can bias the latch member 134 into engagement with the pinion gear 130. When a user desires to change the position of the first and second leg members 108, 110, the user can pivot the handle 132, which in turn causes the latch member 134 to disengage the pinion gear 130, thereby allowing the user to move the desk platform to the desired height. Releasing the handle 132 causes the latch member 134 to re-engage the pinion gear 130, thereby immobilizing the pinion gear 130 and substantially locking the position of the first and second leg members 108, 110 with respect to the platform 102. As best shown in FIGS. 2, 3, and 6, the desk platform 100 can include first and second latching mechanisms, both of which can be substantially as described above. Accordingly, the user may need to disengage both the first and second latch mechanisms in order to change the position of the first and second leg members 108, 110 with respect to the platform 102, however, other configurations are possible.

Still referring to FIGS. 7 and 8, one or more elastic members 140, such as a spring or elastomeric device, may be provided to pre-load or bias the first and second leg members 108, 110 with respect to the platform 102. For example, in the embodiment shown, one of the elastic members 140 can be anchored to the second rack gear 124 at one end, and can be anchored to the lower surface 106 of the platform 102 at the opposite end. The elastic member 140 can be positioned such that moving the leg member 110 from the fully raised position toward the fully lowered position extends the elastic member 140, thereby providing resistance to movement in this lowering direction. Additionally, moving the leg member 110 from the fully lowered position toward the fully raised position can relax the elastic member 140, thereby providing a lift-assist that facilitates moving the desk platform 100 toward a raised position. As shown in FIGS. 7 and 8, another elastic member 140 can also be provided in connection with the first leg member 108 and first rack gear 122. Recesses can be provided in the lower surface 106 of the platform 102 in the vicinity of the elastic members 140, e.g., to provide adequate clearance, however, other configurations are possible. The elastic members 140 are not limited to the configuration shown. Rather, other configurations are possible, as will be appreciated by one of ordinary skill in the art based on this disclosure.

As shown in FIG. 8, one or more standoffs 150 can be connected to the lower surface 106 of the platform 102 to maintain the first and/or second leg members 108, 110 in proper position with respect to the lower surface 106 when in the fully lowered position.

Referring generally to FIGS. 1 and 6, the height of desk platform 100 can be adjusted by the user to suit his or her needs or environment. For example, FIG. 6 shows the desk platform in a fully lowered position. By pivoting the handles 132, the user can disengage the latch mechanism from the rack and pinion gear system 120, thereby allowing the first and second leg members 108, 110 to raise with respect to the platform 102, for example, under the "lift assist" provided by optional elastic members 40. The user can then move the platform 102 to one of the intermediate positions, or to the fully raised position, and release the handle to re-engage the latch mechanism and rack and pinion gear system 120, thereby substantially locking the first and second leg members 108, 110 in place. FIG. 1 shows the desk platform 100 in the fully raised position. After use, or when a change of position is needed, the user can once again pivot the handles 132 to disengage the latch mechanism from the rack and pinion gear system 120 to move the platform 102 to the desired position. In the case of storage, the user can move the platform 102 to the fully lowered position shown in FIG. 6 to provide a compact configuration for storage. Movement of the platform 102 from the fully raised position toward the fully lowered position can extend the elastic members 140, thereby providing a dampening effect to the lowering motion.

Figure 9:
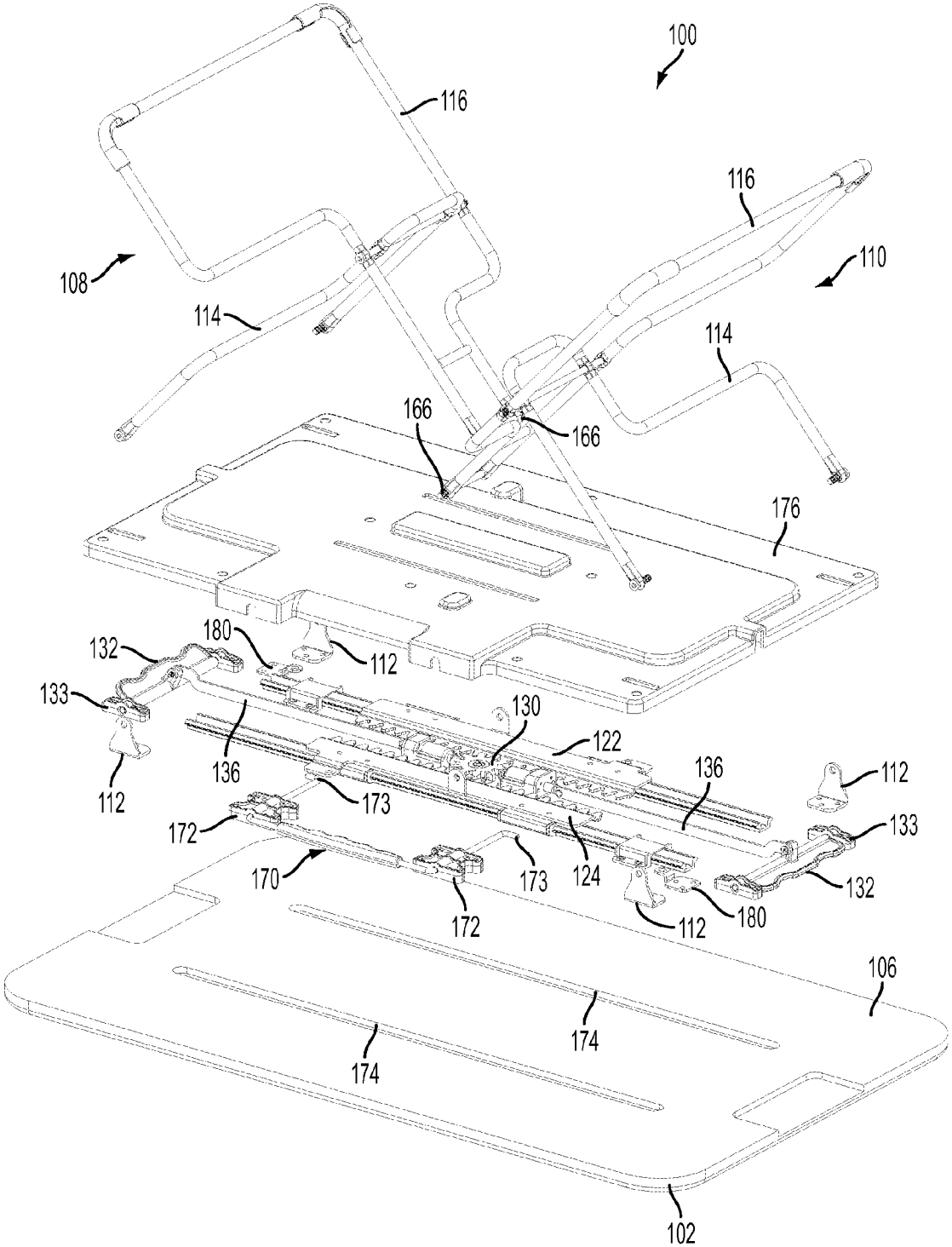
FIG. 9 depicts a bottom, perspective, partially exploded view of another embodiment of an adjustable height desk platform.
Figure 10:
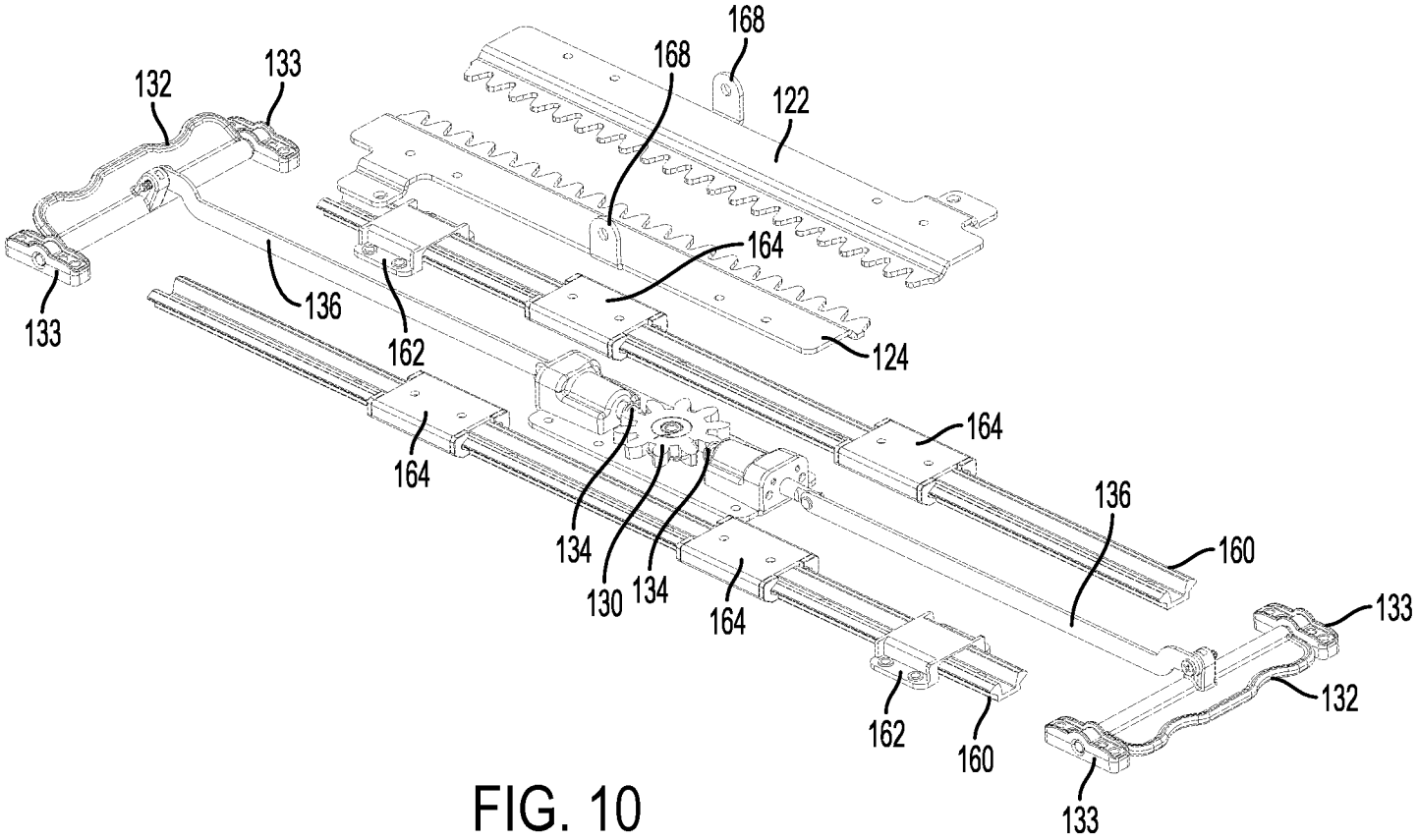
FIG. 10 depicts a partially exploded, perspective view of a portion of FIG. 9.

FIG. 9 depicts a bottom, perspective, partially exploded view of another embodiment of the adjustable height desk platform 100. FIG. 10 depicts a partially exploded, perspective view of a portion of FIG. 9. The same reference numbers are used in FIGS. 9 and 10 to identify items that are the same as, or substantially similar to, features shown FIGS. 1-8. Only significant differences between the embodiment of FIGS. 1-8 and the embodiment of FIGS. 9-10 are described below.

Referring to FIG. 10, the desk platform 100 can use tracks 160 to couple the first and second rack gears 122, 124 to the lower surface of the platform 102. As shown, each of the tracks 160 can be secured to the lower surface of the platform 102 using mounting brackets 162 that extend over the tracks 160, however, other configurations are possible. For example, the tracks 160 can alternatively be screwed directly to the platform 102.

Still referring to FIG. 10, one or more slide members 164 can connect each rack gear 122, 124 to the respective track 160. According to an embodiment, the tracks 160 can define an outer profile that compliments an inner profile of the slide members 164. As a result, the slide members 164 are retained on the tracks 160 in a manner that permits sliding of the sliding members 164 along the tracks 160. The rack gears 122, 124 can in turn be connected to the respective sliding members 164, for example, using fasteners, bonding, adhesives, or other structures. As with the embodiment of FIGS. 1-8, the second leg components 116 can couple to the respective rack gears 122, 124 using mounting tabs 168 on the rack gears 122, 124, and respective fasteners 166 located on the second leg components 116, however, other configurations are possible.

Referring to FIG. 9, embodiments of the desk platform 100 can include a carrying handle 170. The carrying handle 170 can be used by a user to facilitate transport of the desk platform. As shown in FIG. 9, the handle 170 can mount to the lower surface of platform 102 using brackets 172. The handle can slide within brackets 172, allowing the handle 170 to move between a carrying position and a retracted position. Bent ends 173 or other retaining structures can prevent the handle 170 from disconnecting from the brackets 172 when in the carrying position.

When in the retracted position, the entire handle 170 can be located behind the adjacent edge of the platform 102, such that none of the handle 170 protrudes laterally beyond the perimeter of the platform 102. In the extended position, a portion of the handle 170 can extend laterally beyond the perimeter of the platform 102, to provide a surface for the user to grip.

As shown in FIG. 9, recesses 174 can be provided in the lower surface 106 of the platform 102 in the vicinity of the tracks 160, or other components, to facilitate the desk platform 100 having a low profile. Additionally, the desk platform 100 can include a cover 176 coupled to the lower surface of the platform 102. As shown, the cover 176 can extend over all or a substantial portion of the rack and pinion gear system, as well as the latch mechanism. Additionally or alternatively, the cover 176 can extend over the tracks 160 and associated components. As a result, the cover 176 can conceal many or all of the mechanical components of the deck platform 100 (e.g., all but the legs 108, 110 and other components that need to be exposed). This can add to the aesthetics and safety of the desk platform 100. With reference to FIG. 9, brackets 180 can secure to the lower surface 106 of platform 102, as well as to the cover 176 (e.g., using screws or other fasteners) to attach cover 176 on the platform 102. Additionally or alternatively, other fasteners, adhesives, or know structures can be used to attach the cover 176 to the platform.

The embodiments illustrated and discussed in this specification are intended only to teach those skilled in the art the best way known to the inventors to make and use the invention. Nothing in this specification should be considered as limiting the scope of the present invention. For example, the arrangement of features with respect to the upper platform and the lower platform, such as, e.g., the locking mechanism, can be reversed. All examples presented are representative and non-limiting. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

The invention claimed is:

1. An adjustable height desk platform, comprising:

a platform including a substantially flat work surface and a lower surface opposite to the work surface;

a first leg member and a second leg member hinged to the lower surface by brackets, the first leg member and the second leg member each pivotable between a raised position inclined with respect to the lower surface and a lowered position substantially parallel to the lower surface;

a rack and pinion gear system located on the lower surface of the platform and coupled to the first leg member and the second leg member; and a latch mechanism associated with the rack and pinion gear system, the latch mechanism adapted to selectively immobilize the rack and pinion gear system to retain the first leg member and the second leg member in the raised position or the lowered position.

2. The adjustable height desk platform of claim 1, wherein the latch mechanism is further adapted to selectively immobilize the rack and pinion gear system to retain the first leg member and the second leg member in at least one intermediate position between the raised position and the lowered position.

3. An adjustable height desk platform, comprising:

a platform including a substantially flat work surface and a lower surface opposite to the work surface;

a first leg member and a second leg member coupled to the lower surface, the first leg member and the second leg member each movable between a raised position and a lowered position;

a rack and pinion gear system comprising:

a first rack gear coupled to the first leg member, the first rack gear slidably mounted to the lower surface of the platform;

a second rack gear coupled to the second leg member, the second rack gear slidably mounted to the lower surface of the platform; and a pinion gear in contact with the first rack gear and the second rack gear; and a latch mechanism associated with the rack and pinion gear system, the latch mechanism adapted to selectively immobilize the rack and pinion gear system to retain the first leg member and the second leg member in the raised position or the lowered position.

4. The adjustable height desk platform of claim 3, wherein the first rack gear and the second rack gear are mounted to the lower surface of the platform for movement substantially in parallel to one another.

5. The adjustable height desk platform of claim 4, wherein the pinion gear is located between the first rack gear and the second rack gear.

6. The adjustable height desk platform of claim 3, wherein the pinion gear is mounted to the lower surface of the platform for rotation with respect to the lower surface of the platform.

7. The adjustable height desk platform of claim 3, wherein the first rack gear and second rack gear are each coupled to the lower surface of the platform by a linear bearing.

8. The adjustable desk platform of claim 3, further comprising a first track and a second track, wherein the first rack gear is slidably mounted to the first track, and the second rack gear is slidably mounted to the second track.

9. The adjustable desk platform of claim 8, further comprising a first slide member coupling the first rack gear to the first track, and a second slide member coupling the second rack gear to the second track.

10. The adjustable height desk platform of claim 3, wherein the latch mechanism comprises a latch member adapted to selectively engage the pinion gear.

11. The adjustable height desk platform off claim 10, wherein the latch member is releasably biased into engagement with the pinion gear, the latch mechanism further comprising a handle operable by a user to disengage the latch member from the pinion gear.

12. The adjustable height desk platform of claim 11, wherein the latch mechanism comprises a linkage member coupling the latch member to the handle.

13. The adjustable height desk platform of claim 1, further comprising a second latch mechanism associated with the rack and gear system, the second latch mechanism adapted to selectively immobilize the rack and pinion gear system to retain the first leg member and the second leg member in the raised position or the lowered position.

14. An adjustable height desk platform, comprising:

a platform including a substantially flat work surface and a lower surface opposite to the work surface;

a first leg member and a second leg member coupled to the lower surface, the first leg member and the second leg member each movable between a raised position and a lowered position;

a rack and pinion gear system located on the lower surface of the platform and coupled to the first leg member and the second leg member;

a latch mechanism associated with the rack and pinion gear system, the latch mechanism adapted to selectively immobilize the rack and pinion gear system to retain the first leg member and the second leg member in the raised position or the lowered position; and an elastic member coupled to the first leg member, the elastic member moveable between an extended position when the first leg member is in the lowered position, and a relaxed position when the first leg member is in the raised position.

15. The adjustable desk platform of claim 14, wherein the elastic member is coupled to the rack and pinion gear mechanism.

16. The adjustable desk platform of claim 14, further comprising a second elastic member coupled to the second leg member, the second elastic member moveable between an extended position when the second leg member is in the lowered position, and a relaxed position when the second leg member is in the raised position.

17. The adjustable desk platform of claim 1, wherein each of the first leg member and the second leg member comprises:

a first leg component coupled to the lower surface of the platform; and a second leg component coupled to the first leg component, wherein the second leg component is coupled to the rack and pinion gear system.

18. The adjustable desk platform of claim 17, wherein the first leg component is pivotably connected to the lower surface of the platform.

19. The adjustable desk platform of claim 1, wherein the entire work surface is substantially flat and unobstructed.

20. The adjustable desk platform of claim 1, wherein the platform comprises at least one of plastic, composite, wood, particle board, or cardboard.

21. The adjustable desk platform of claim 1, wherein the work surface defines a length of between about 15 inches and about 36 inches, and a width of between about 10 inches and about 20 inches.

22. The adjustable desk platform of claim 1, further comprising a carrying handle coupled to the lower surface of the platform, the handle movable between a carrying position where a portion of the handle is located on one side of an edge of the platform, and a retracted position where the entire handle is located on an opposite side of the edge of the platform.

23. An adjustable height desk platform, comprising:

a platform including a substantially flat work surface and a lower surface opposite to the work surface;

a first leg member and a second leg member coupled to the lower surface, the first leg member and the second leg member each movable between a raised position and a lowered position;

a rack and pinion gear system located on the lower surface of the platform and coupled to the first leg member and the second leg member;

a latch mechanism associated with the rack and pinion gear system, the latch mechanism adapted to selectively immobilize the rack and pinion gear system to retain the first leg member and the second leg member in the raised position or the lowered position; and a cover mounted to the lower surface of the platform and extending from the lower surface of the platform over at least the rack and pinion gear system and a portion of the latch mechanism.

24. A method of using the desk platform of claim 1, comprising:

disengaging the latch mechanism;

lifting the platform, thereby raising the first leg member and the second leg member from the lowered position to the raised position; and re-engaging the latch mechanism.

25. The method of claim 24, further comprising:

disengaging the latch mechanism;

lowering the platform, thereby lowering the first leg member and the second leg member from the raised position to the lowered position; and re-engaging the latch mechanism.

26. The method of claim 24, further comprising:

disengaging the latch mechanism;

lowering the platform, thereby lowering the first leg member and the second leg member from the raised position to an intermediate position between the raised position and the lowered position; and re-engaging the latch mechanism.

* * * * *